US009349324B2

(12) United States Patent
Chang et al.

(10) Patent No.: US 9,349,324 B2
(45) Date of Patent: May 24, 2016

(54) PIXEL CIRCUIT AND DISPLAY DEVICE USING THE SAME

(71) Applicant: AU OPTRONICS CORP., Hsin-Chu (TW)

(72) Inventors: Hua-Gang Chang, Hsin-Chu (TW); Man-Wen Shih, Hsin-Chu (TW); Ching-Kai Lo, Hsin-Chu (TW); Chien-Chung Huang, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 106 days.

(21) Appl. No.: 14/444,157

(22) Filed: Jul. 28, 2014

(65) Prior Publication Data

US 2015/0287364 A1 Oct. 8, 2015

(30) Foreign Application Priority Data

Apr. 8, 2014 (TW) ..... 103112824 A

(51) Int. Cl.
*G09G 3/32* (2016.01)

(52) U.S. Cl.
CPC ..... *G09G 3/3291* (2013.01); *G09G 3/3233* (2013.01); *G09G 3/3258* (2013.01); *G09G 3/3266* (2013.01); *G09G 2300/0819* (2013.01); *G09G 2300/0852* (2013.01); *G09G 2300/0861* (2013.01); *G09G 2310/0248* (2013.01); *G09G 2310/061* (2013.01); *G09G 2320/0233* (2013.01); *G09G 2320/043* (2013.01)

(58) Field of Classification Search
None
See application file for complete search history.

(56) References Cited

U.S. PATENT DOCUMENTS 8,791,888 B2 * 7/2014 Uchino ..... G09G 3/3233 345/78
9,153,173 B2 * 10/2015 Chang ..... G09G 3/3233
2005/0052377 A1 * 3/2005 Hsueh ..... G09G 3/3233 345/82
2007/0115224 A1 * 5/2007 Yamamoto ..... G09G 3/3233 345/76
2009/0201231 A1 * 8/2009 Takahara ..... G09G 3/3233 345/76
2010/0225623 A1 * 9/2010 Ohhashi ..... G09G 3/3233 345/205
2011/0090200 A1 * 4/2011 Choi ..... G09G 3/3233 345/211
2011/0169805 A1 * 7/2011 Yamazaki ..... G09G 3/344 345/211
2012/0098810 A1 * 4/2012 Nieh ..... G09G 3/3233 345/211
2014/0111503 A1 * 4/2014 Kwon ..... G09G 3/3233 345/213
2014/0347401 A1 * 11/2014 Hwang ..... G09G 3/3233 345/690

FOREIGN PATENT DOCUMENTS

CN 103150992 A 6/2013
TW I409761 10/2011

* cited by examiner

*Primary Examiner* — Antonio Xavier
(74) *Attorney, Agent, or Firm* — WPAT, PC; Justin King

(57) ABSTRACT

A pixel circuit includes four transistors, two capacitors and a light emitting element. A gate of first transistor receives a scan signal and a source/drain thereof receives a display data. A terminal of first capacitor couples to another source/drain of first transistor. A gate and a source/drain of second transistor couple to another terminal of first capacitor; and another source/drain thereof receives a switch signal. A terminal of second capacitor receives a reset signal; and another terminal thereof couples to another terminal of first capacitor. A gate of third transistor couples to a terminal of first capacitor. A gate of fourth transistor receives an enable signal; a source/drain thereof couples to a first power supply voltage; and another source/drain thereof couples to one source/drain of third transistor. The anode and cathode of the light emitting element couple to one source/drain of third transistor and a second power supply voltage, respectively.

11 Claims, 5 Drawing Sheets

PIXEL CIRCUIT AND DISPLAY DEVICE USING THE SAME

TECHNICAL FIELD

The present disclosure relates to a technical field of organic light emitting diode display, and more particularly to a pixel circuit using an organic light-emitting diode and a display device using the same.

BACKGROUND

Conventionally, each pixel circuit, arranged in an organic light emitting diode (OLED) display device and for controlling the brightness of an organic light emitting diode, is implemented with two transistors and one capacitor. However, most of the existing display panels have the non-uniformity issue due to the circuit design flaw in the conventional pixel circuit. The detail will be described in the following with a reference of FIG. 1.

FIG. 1 is a schematic view of a conventional pixel circuit. As shown, the conventional pixel circuit 100 includes a transistor 101, a transistor 102, a capacitor 103 and an organic light emitting diode 104. The transistor 101 is configured to have its gate for receiving a scan signal SCAN and its first source/drain for receiving display data DATA. The transistor 102 is configured to have its gate electrically coupled to the second source/drain of the transistor 101 and electrically coupled to a power supply voltage OVDD and its first source/drain through the capacitor 103. The organic light emitting diodes 104 is configured to have its anode electrically coupled to the second source/drain of the transistor 102 and its cathode electrically coupled to a power supply voltage OVSS; wherein the power supply voltage OVSS is smaller than the power supply voltage OVDD. According to the aforementioned circuit structure, it is noted that the current flowing through the organic light emitting diodes 104 is controlled by the crossing voltage between the gate and the second source/drain of the transistor 102. That is, $I_{OLED}=K*(V_{GS}-|V_{th}|)^2$; wherein $I_{OLED}$ is referred to the current flowing through the organic light emitting diode 104, K is a constant, $V_{GS}$ is referred to the crossing voltage between the gate and the second source/drain of the transistor 102 and is related to the voltage of the display data DATA, and $V_{th}$ is referred to the threshold voltage of the transistor 102.

However, because the metal wires, for connecting each pixel circuit 100 to the power supply voltage OVDD, may have impedances, the IR-drop may occur when the power supply voltage OVDD is driving the organic light emitting diodes 104 to illuminate light. Thus, the pixel circuits 100 may have different pixel currents $I_{OLED}$ and consequentially the organic light emitting diodes 104 may have different brightness. As a result, the non-uniformity issue occurs. In addition, the transistor 102 in each pixel circuit 100 may not have the same threshold voltage $V_{th}$ due to the impact of the manufacturing process. Similarly, the pixel circuits 100 may have different pixel currents $I_{OLED}$ and consequentially the organic light emitting diodes 104 may have different brightness. As a result, the non-uniformity issue also occurs.

SUMMARY

An aspect of the present disclosure is to provide a pixel circuit capable of improving the non-uniformity issue.

Another aspect of the present disclosure is to provide a display device using the aforementioned pixel circuit.

The present disclosure provides a pixel circuit, which includes a first transistor, a first capacitor, a second transistor, a second capacitor, a third transistor, a fourth transistor and a light emitting element. The first transistor includes a first gate, a first source/drain and a second source/drain. The first gate is for receiving a scan signal; and the first source/drain is for receiving a display data. The first capacitor includes a first terminal and a second terminal. The first terminal is electrically coupled to the second source/drain. The second transistor includes a second gate, a third source/drain and a fourth source/drain. The second gate and the third source/drain are electrically coupled to the second terminal of the first capacitor; and the fourth source/drain is for receiving a switch signal. The second capacitor includes a third terminal and a fourth terminal. The third terminal is for receiving a reset signal; and the fourth terminal is electrically coupled to the second terminal of the first capacitor. The third transistor includes a third gate, a fifth source/drain and a sixth source/drain. The third gate is electrically coupled to the first terminal of the first capacitor. The fourth transistor includes a fourth gate, a seventh source/drain and an eighth source/drain. The fourth gate is for receiving an enable signal; the seventh source/drain is electrically coupled to a first power supply voltage; and the eighth source/drain is electrically coupled to the fifth source/drain. The light emitting element includes an anode and a cathode. The anode is electrically coupled to the sixth source/drain; and the cathode is electrically coupled to a second power supply voltage. The second power supply voltage is smaller than the first power supply voltage.

The present disclosure further provides a display device, which includes a display panel, a data driver and a scan driver. The display panel includes a plurality of pixel circuits. Each pixel circuit includes a first transistor, a first capacitor, a second transistor, a second capacitor, a third transistor, a fourth transistor and a light emitting element. The first transistor includes a first gate, a first source/drain and a second source/drain. The first gate is for receiving a scan signal; and the first source/drain is for receiving a display data. The first capacitor includes a first terminal and a second terminal. The first terminal is electrically coupled to the second source/drain. The second transistor includes a second gate, a third source/drain and a fourth source/drain. The second gate and the third source/drain are electrically coupled to the second terminal of the first capacitor; and the fourth source/drain is for receiving a switch signal. The second capacitor includes a third terminal and a fourth terminal. The third terminal is for receiving a reset signal; and the fourth terminal is electrically coupled to the second terminal of the first capacitor. The third transistor includes a third gate, a fifth source/drain and a sixth source/drain. The third gate is electrically coupled to the first terminal of the first capacitor. The fourth transistor includes a fourth gate, a seventh source/drain and an eighth source/drain. The fourth gate is for receiving an enable signal; the seventh source/drain is electrically coupled to a first power supply voltage; and the eighth source/drain is electrically coupled to the fifth source/drain. The light emitting element includes an anode and a cathode. The anode is electrically coupled to the sixth source/drain; and the cathode is electrically coupled to a second power supply voltage. The second power supply voltage is smaller than the first power supply voltage. The data driver is configured to provide the display data. The scan driver is configured to provide the scan signal, the reset signal and the enable signal. In a pre-charge period, the scan signal and the enable signal are configured to have high voltage levels and the switch signal is configured to have a low voltage level. In a reset-and-compensation period, the scan signal, the switch signal and the enable signal are configured to have high voltage levels. In a data writing period, the scan signal and the switch signal are configured to have high voltage levels and the enable signal and the reset signal are configured to low voltage levels. In an emission period, the scan signal and the reset signal are configured to have low voltage levels and the switch signal and the enable signal are configured to have high voltage levels. The reset-and-compensation period is after the pre-charge period; the data writing period is after the reset-and-compensation period; and the emission period is after the data writing period.

In summary, by designing a pixel circuit with four transistors, two capacitors and a light emitting element, the current flowing through the light emitting element is only related to the capacitors and display data. Thus, the pixel circuit and the display panel using the same of the present disclosure is prevented from having the non-uniformity issue and the light emitting element degradation issue; and consequentially the display quality is improved.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
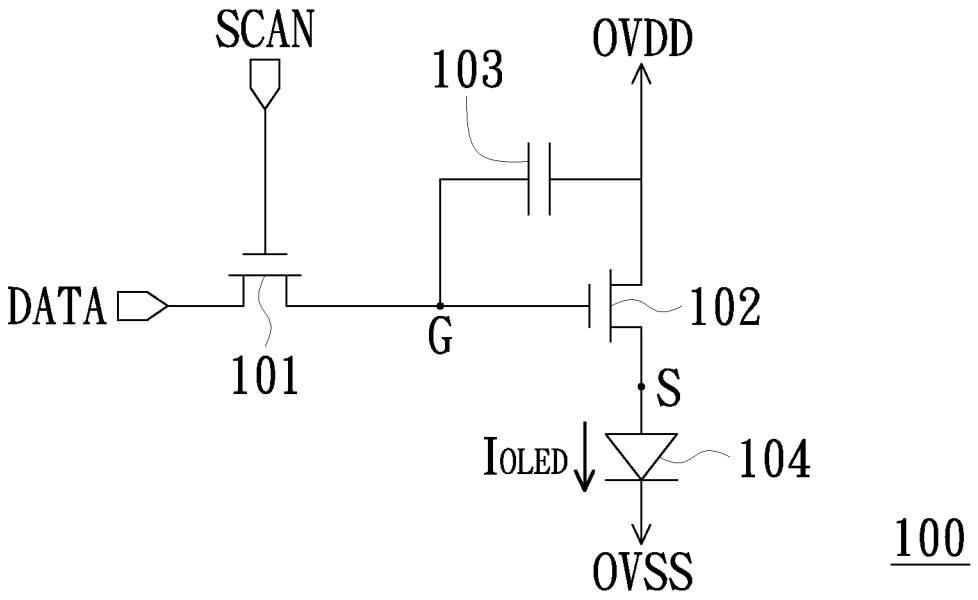
FIG. 1 (Prior Art)
FIG. 1 is a schematic view of a conventional pixel circuit.
Figure 2:
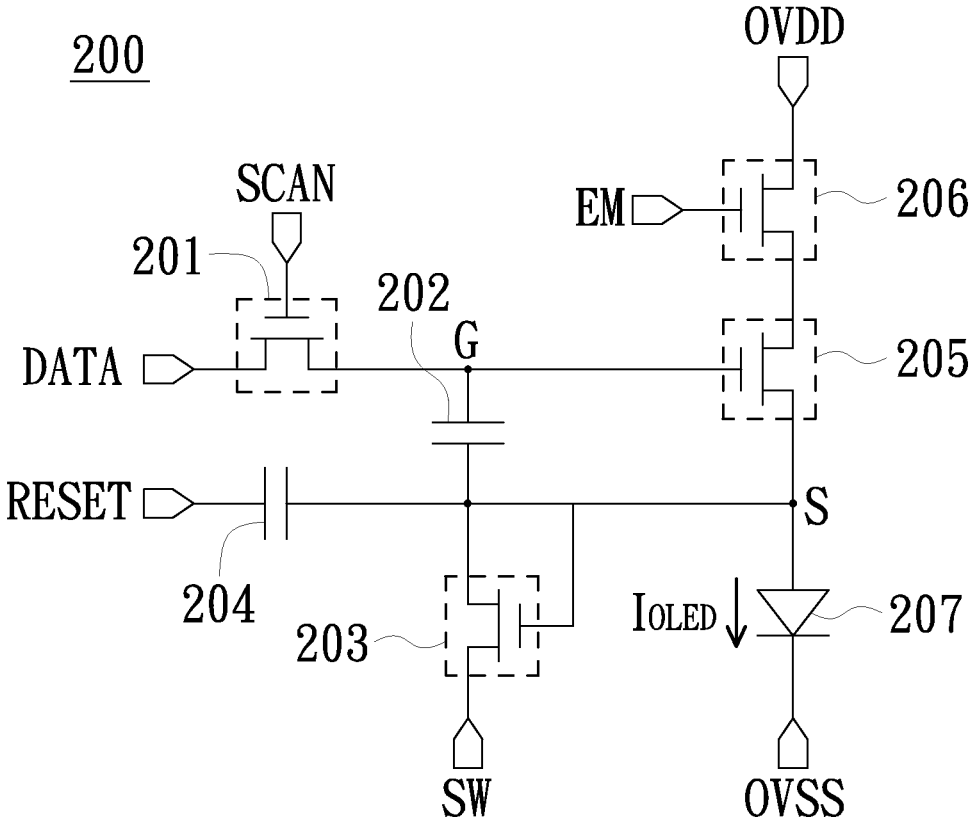
FIG. 2 is a schematic view of a pixel circuit in accordance with an embodiment of the present disclosure.

FIG. 2 is a schematic view of a pixel circuit in accordance with an embodiment of the present disclosure. As shown, the pixel circuit 200 in the present embodiment includes a transistor 201, a capacitor 202, a transistor 203, a capacitor 204, a transistor 205, a transistor 206 and a light emitting element 207. The transistor 201 is configured to have its gate for receiving a scan signal SCAN and its first source/drain for receiving display data DATA. The capacitor 202 is configured to have its first terminal electrically coupled to the second source/drain of the transistors 201. The transistor 203 is configured to have its gate and its first source/drain electrically coupled to the second terminal of the capacitor 202 and its second source/drain for receiving a switch signal SW. The capacitor 204 is configured to have its first terminal for receiving a reset signal RESET and its second terminal electrically coupled to the second terminal of the capacitor 202. The transistor 205 is configured to have its gate electrically coupled to the first terminal of the capacitor 202. The transistor 206 is configured to have its gate for receiving an enable signal EM; its first source/drain electrically coupled to a power supply voltage OVDD; and its second source/drain electrically coupled to the first source/drain of the transistors 205. The light emitting element 207 is configured to have its anode electrically coupled to the second source/drain of the transistor 205 and its cathode electrically coupled to a power supply voltage OVSS. In the present embodiment, the power supply voltage OVSS is smaller than the power supply voltage OVDD; the light emitting element 207 is implemented with an organic light emitting diode; and each one of the transistors 201, 203, 205 and 206 is implemented with a thin film transistor.

Figure 3:
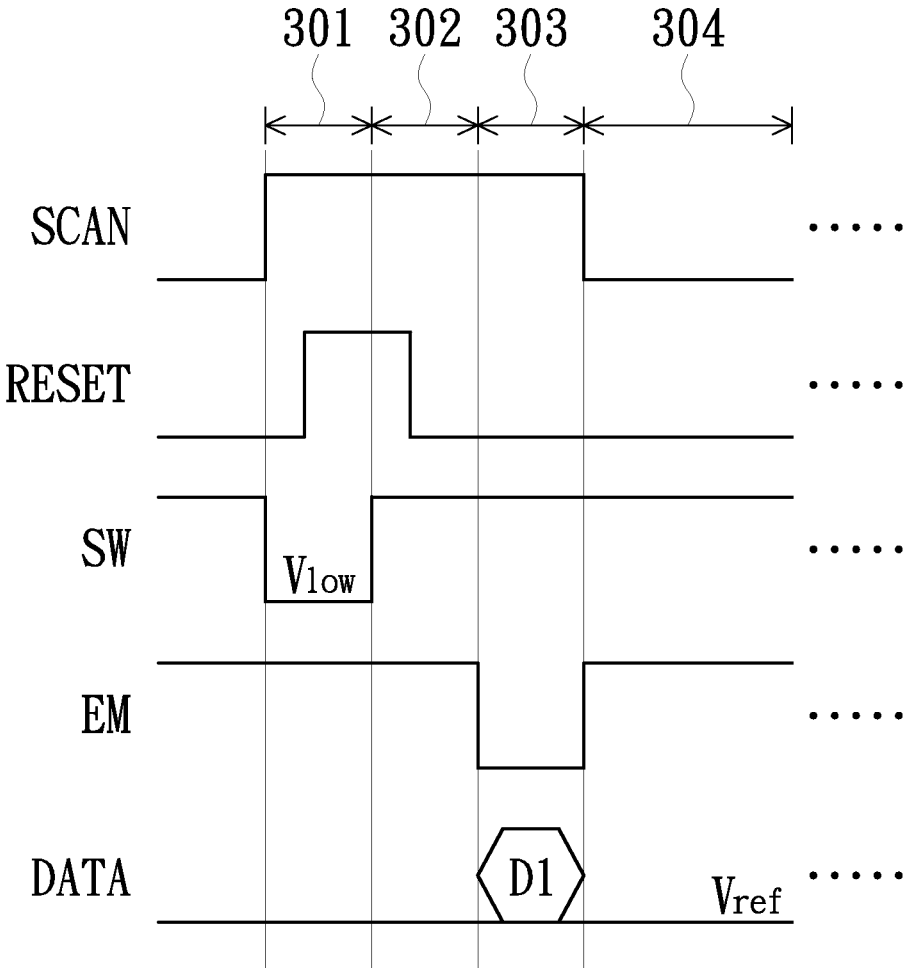
FIG. 3 is a timing diagram of the signals associated with the pixel circuit of FIG. 2.

FIG. 3 is a timing diagram of the signals associated with the pixel circuit 200 of FIG. 2. As shown, 301 is referred to a pre-charge period of the pixel circuit 200; 302 is referred to a reset-and-compensation period of the pixel circuit 200; 303 is referred to a data writing period of the pixel circuit 200; and 304 is referred to an emission period of the pixel circuit 200. In the present embodiment, the reset-and-compensation period 302 is after the pre-charge period 301; the data writing period 303 is after the reset-and-compensation period 302; and the emission period 304 is after the data writing period 303.

Please refer to FIGS. 2 and 3. In the pre-charge period 301, both of the scan signal SCAN and the enable signal EM are configured to have high voltage levels and the switch signal SW is configured to have a low voltage level. Because the scan signal SCAN and the enable signal EM have high voltage levels and the switch signal SW has a low voltage level, both of the transistor 201 and the transistor 206 are ON. Moreover, in the pre-charge period 301, the rising edge of the reset signal RESET is after the rising edge of the scan signal SCAN and the falling edge of the switch signal SW; and accordingly the transistor 203 is ON. As a result, the voltages at the node G and the node S in the pre-charge period 301 can be obtained by the following equation (1) and equation (2), respectively:

$$V_G=V_{ref} \tag{1}$$

$$V_S=V_{low}+V_{th'} \tag{2}$$

In the aforementioned equations (1) and (2), $V_G$ is referred to the voltage at the node G; $V_S$ is referred to the voltage at the node S; $V_{ref}$ is referred to the reference voltage of the display data DATA; $V_{low}$ is referred to the low-level voltage of the switch signal SW; and $V_{th'}$ is referred to the threshold voltage of the transistor 203.

Next, in the reset-and-compensation period 302, the scan signal SCAN, the switch signal SW and the enable signal EM are configured to have high voltage levels. Because the scan signal SCAN, the switch signal SW and the enable signal EM have high voltage levels, both of the transistor 201 and the transistor 206 are ON. Moreover, in the reset-and-compensation period 302, the falling edge of the reset signal RESET is after the rising edge of the switch signal SW; and accordingly the transistor 203 is OFF. As a result, the voltages at the node G and the node S in the reset-and-compensation period 302 can be obtained by the following equation (3) and equation (4), respectively:

$$V_G=V_{ref} \tag{3}$$

$$V_S=V_{ref}-V_{th} \tag{4}$$

In the aforementioned equations (3) and (4), $V_G$ is referred to the voltage at the node G; $V_S$ is referred to the voltage at the node S; $V_{ref}$ is referred to the reference voltage of the display data DATA; and $V_{th}$ is referred to the threshold voltage of the transistor 205.

Figure 4A:
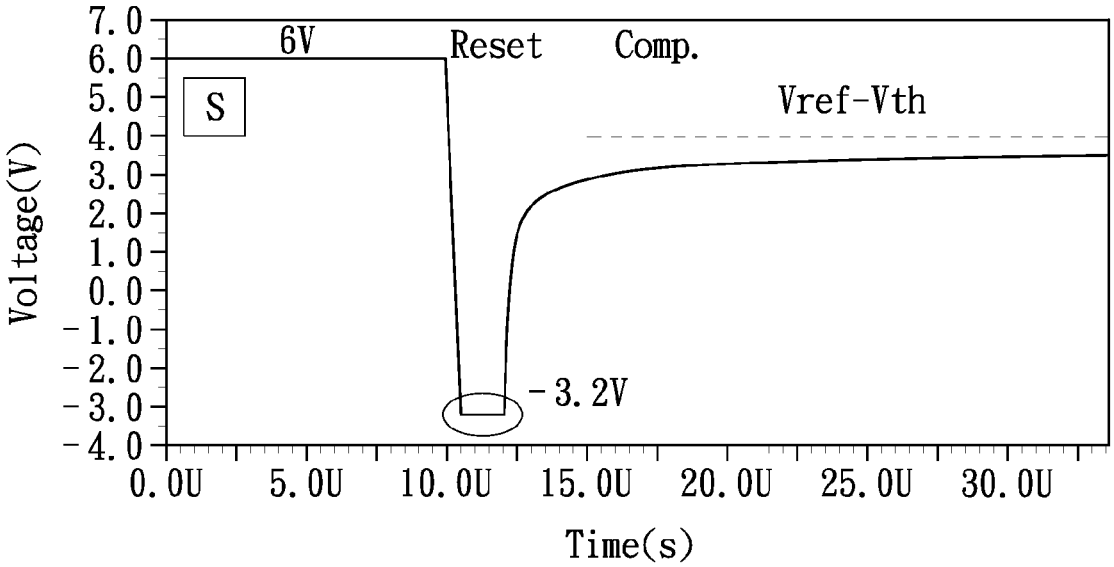
FIG. 4(A) illustrates an experiment simulation waveform of a voltage derived from a conventional pixel circuit.
Figure 4B:
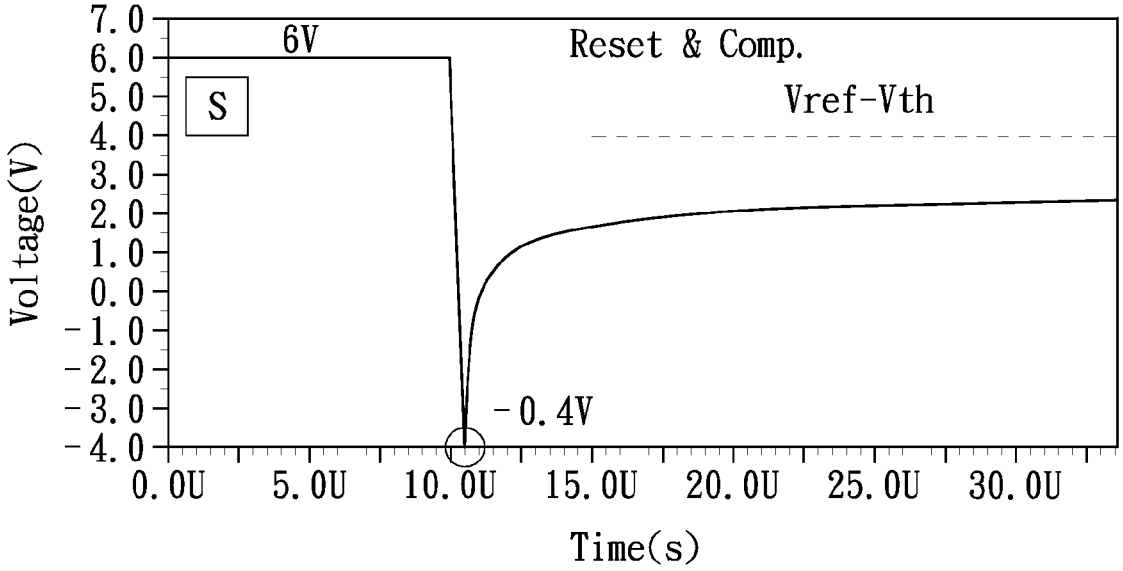
FIG. 4(B) illustrates an experiment simulation waveform of a voltage derived from the pixel circuit of the present disclosure.

In the present embodiment, it is noted that the pixel circuit 200 can, once the voltage difference between the node G and the node S is greater than the threshold voltage $V_{th}$ of the transistor 205, immediately perform a compensation operation without needing to reset the reset signal RESET to a low-level voltage. The detail will be described in the following with a reference of FIGS. 4(A) and 4(B), which illustrate the experiment simulation waveforms of the voltage at the node S obtained by the conventional pixel circuit 100 and the pixel circuit 200 of the present disclosure, respectively. As illustrated in FIG. 4(A), the conventional pixel circuit 100 can perform the compensation operation only when the voltage at the node S is reset to about −3.2V in the reset period. However, as illustrated in FIG. 4(B), the pixel circuit 200 of the present disclosure can perform the compensation operation when the voltage at the node S is reset to about −0.4V in the reset period. Thus, compared with the conventional pixel circuit 100, the pixel circuit 200 of the present disclosure can perform reset and compensation operations within a relatively short time.

Next, in the data writing period 303, the scan signal SCAN and the switch signal SW are configured to have high voltage levels and the enable signal EM and the reset signal RESET are configured to low voltage levels. Because the scan signal SCAN and the switch signal SW have high voltage levels, the transistor 201 is ON. Because the enable signal EM and the reset signal RESET have low voltage levels, the transistors 203 and 206 are OFF. As a result, the voltages at the node G and the node S in the data writing period 303 can be obtained by the following equation (5) and equation (6), respectively:

$$V_G=V_{DATA} \tag{5}$$

$$V_S=V_{ref}V_{th}+dV \tag{6}$$

In the aforementioned equations (5) and (6), $V_G$ is referred to the voltage at the node G; $V_S$ is referred to the voltage at the node S; $V_{DATA}$ is referred to the voltage of the display data DATA; $V_{ref}$ is referred to the reference voltage of the display data DATA;

$$dV = \frac{C1}{C1 + C2} \times (V_{DATA} - V_{ref});$$

C1 is referred to the capacitance of the capacitor 202; and C2 is referred to the capacitance of the capacitor 204.

Finally, in the emission period 304, the switch signal SW and the enable signal EM are configured to have high voltage levels, thereby configuring the transistor 206 ON. Moreover, in the emission period 304, the scan signal SCAN and the reset signal RESET are configured to have low voltage levels, thereby configuring the transistor 201 and the transistor 203 OFF. As a result, the voltages at the node G and the node S in the emission period 304 can be obtained by the following equation (7) and equation (8), respectively:

$$V_G=V_{DATA}+OVSS+V_{OLED}-V_{ref}+V_{th}-dV \tag{7}$$

$$V_S=OVSS+V_{OLED} \tag{8}$$

In the aforementioned equations (7) and (8), $V_G$ is referred to the voltage at the node G; $V_S$ is referred to the voltage at the node S; $V_{DATA}$ is referred to the voltage of the display data DATA; OVSS is referred to a power supply voltage; $V_{OLED}$ is referred to the crossing voltage of the light emitting element 207; $V_{ref}$ is referred to the reference voltage of the display data DATA; $V_{th}$ is referred to the threshold voltage of the transistor 205;

$$dV = \frac{C1}{C1 + C2} \times (V_{DATA} - V_{ref});$$

C1 is referred to the capacitance of the capacitor 202; and C2 is referred to the capacitance of the capacitor 204.

In addition, the crossing voltage between the node G and the node S can be obtained by the following equation (9):

$$V_{GS}=V_{DATA}-V_{ref}+V_{th}-dV \tag{9}$$

In addition, the current flowing through the light emitting element 207 can be obtained by the following equation (10):

$$I_{OLED}=K*(V_{GS}-|V_{th}|)^2 \tag{10}$$

According to the equations (9) and (10), the current flowing through the light emitting element 207 can be obtained by the following another equation (11):

$$I_{OLED}=K*(V_{DATA}-V_{ref}-dV)^2 \tag{11}$$

According to the equation (11), it is noted that the pixel current $I_{OLED}$ flowing through the light emitting element 207 in the emission period 304 is only related to the capacitances of the capacitors 202 and 204 and the display data DATA. As a result, the non-uniformity issue of a display panel, resulted by the impact of the IR-drop on the light emitting element 207 and the impact of the manufacturing process on the threshold voltage $V_{th}$ of the transistor 205, is effectively improved, thereby the display panel is capable of providing high-quality images.

Figure 5:
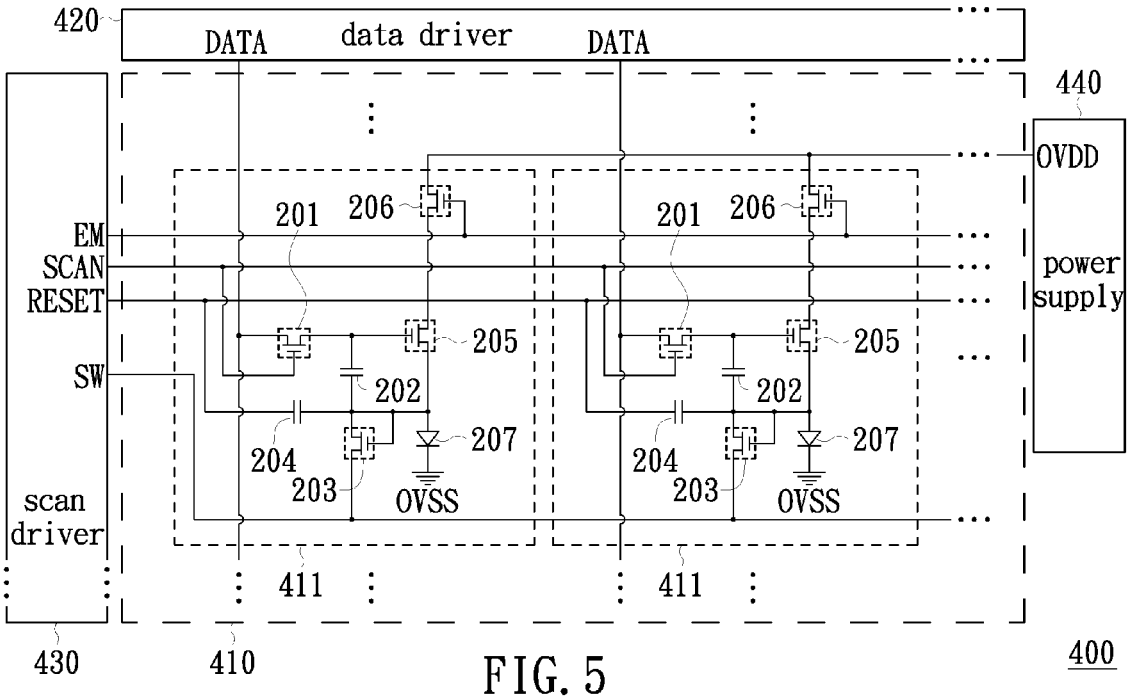
FIG. 5 is a schematic view of a display device in accordance with an embodiment of the present disclosure.

FIG. 5 is a schematic view of a display device in accordance with an embodiment of the present disclosure. As shown, the display device 400 in the present embodiment is implemented with an organic light emitting diode display and includes a display panel 410, a data driver 420, a scan driver 430 and a power supply 440. The display panel 410 includes a plurality of pixel circuits 411, and each pixel circuit 411 is implemented with the pixel circuit 200 of FIG. 2. In each pixel circuit 411, specifically, the gate of the transistor 201 receives the scan signal SCAN provided from the scan driver 430 through a respective scan signal line. The first source/drain of the transistor 201 receives the display data DATA provided from the data driver 420 through a respective data signal line. The second source/drain of the transistor 203 receives the switch signal SW provided from the scan driver 430 through a respective switch signal line. The first terminal of the capacitor 204 receives the reset signal RESET provided from the scan driver 430 through a respective reset signal line. The gate of the transistor 206 receives the enable signal EM provided from the scan driver 430 through a respective enable signal line. The first source/drain of the transistor 206 receives the power supply voltage OVDD provided form the power supply 440 through a respective power supply line. The anode of the light emitting element 207 is electrically coupled to the power supply voltage OVSS. In one embodiment, the power supply voltage OVSS is a ground voltage and accordingly the anode of the light emitting element 207 is electrically coupled to ground. In another embodiment, the power supply voltage OVSS can be any voltage smaller than the aforementioned power supply voltage OVDD and is provided from the power supply 440 through a respective power supply line.

In one embodiment, the scan driver 430 is configured to drive each of the pixel drive circuit 411 according to the time sequence illustrated in FIG. 3. Please refer to FIGS. 5 and 3. Specifically, in the pre-charge period 301, the scan driver 430 is configured to output a high-level scan signal SCAN, a high-level enable signal EM and a low-level switch signal SW, thereby configuring the transistors 201, 203 and 206 ON. In the reset-and-compensation period 302, the scan driver 430 is configured to output a high-level scan signal SCAN, a high-level enable signal EM and a high-level switch signal SW, thereby configuring the transistors 201 and 206 ON and the transistor 203 OFF. In the data writing period 303, the scan driver 430 is configured to output a high-level scan signal SCAN, a low-level enable signal EM, a high-level switch signal SW and a low-level reset signal RESET, thereby configuring the transistor 201 ON and the transistors 203 and 206 OFF. In the emission period 304, the scan driver 430 is configured to output a low-level scan signal SCAN, a high-level enable signal EM, a high-level switch signal SW and a low-level reset signal RESET, thereby configuring the transistor 206 ON and the transistors 201 and 203 OFF. In addition, as described above, the reset-and-compensation period 302 is after the pre-charge period 301; the data writing period 303 is after the reset-and-compensation period 302; and the emission period 304 is after the data writing period 303.

In summary, by designing a pixel circuit with four transistors, two capacitors and a light emitting element, the current flowing through the light emitting element is only related to the capacitors and display data. Thus, the pixel circuit and the display panel using the same of the present disclosure is prevented from having the non-uniformity issue and the light emitting element degradation issue; and consequentially the display quality is improved.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A pixel circuit, comprising:

a first transistor, comprising a first gate, a first channel terminal and a second channel terminal, wherein the first gate is for receiving a scan signal, and the first channel terminal is for receiving a display data;

a first capacitor, comprising a first terminal and a second terminal, wherein the first terminal is directly coupled to the second channel terminal;

a second transistor, comprising a second gate, a third channel terminal and a fourth channel terminal, wherein the second gate and the third channel terminal are directly coupled to the second terminal of the first capacitor, and the fourth channel terminal is for receiving a switch signal;

a second capacitor, comprising a third terminal and a fourth terminal, wherein the third terminal is for receiving a reset signal, and the fourth terminal is electrically coupled to the second terminal of the first capacitor;

a third transistor, comprising a third gate, a fifth channel terminal and a sixth channel terminal, wherein the third gate is directly coupled to the first terminal of the first capacitor;

a fourth transistor, comprising a fourth gate, a seventh channel terminal and an eighth channel terminal, wherein the fourth gate is for receiving an enable signal, the seventh channel terminal is electrically coupled to a first power supply voltage, and the eighth channel terminal is electrically coupled to the fifth channel terminal; and a light emitting element, comprising an anode and a cathode, wherein the anode is electrically coupled to the sixth channel terminal, and the cathode is electrically coupled to a second power supply voltage, wherein the second power supply voltage is smaller than the first power supply voltage.

2. The pixel circuit according to claim 1, wherein in a pre-charge period, the scan signal and the enable signal are configured to have high voltage levels and the switch signal is configured to have a low voltage level, wherein in a reset-and-compensation period, the scan signal, the switch signal and the enable signal are configured to have high voltage levels, wherein in a data writing period, the scan signal and the switch signal are configured to have high voltage levels and the enable signal and the reset signal are configured to low voltage levels, wherein in an emission period, the scan signal and the reset signal are configured to have low voltage levels and the switch signal and the enable signal are configured to have high voltage levels, wherein the reset-and-compensation period is after the pre-charge period, the data writing period is after the reset-and-compensation period, and the emission period is after the data writing period.

3. The pixel circuit according to claim 2, wherein in the pre-charge period, a rising edge of the reset signal is after a rising edge of the scan signal and a falling edge of the switch signal, wherein in the reset-and-compensation period, a falling edge of the reset signal is after a rising edge of the switch signal.

4. The pixel circuit according to claim 1, wherein the light emitting element is implemented with an organic light emitting diode.

5. The pixel circuit according to claim 1, wherein each one of the first transistor, the second transistor, the third transistor and the fourth transistor is implemented with a thin film transistor.

6. A display device, comprising:

a display panel, comprising a plurality of pixel circuits, each one of the plurality of pixel circuit comprising:

a first transistor, comprising a first gate, a first channel terminal and a second channel terminal, wherein the first gate is for receiving a scan signal, and the first channel terminal is for receiving a display data;

a first capacitor, comprising a first terminal and a second terminal, wherein the first terminal is electrically coupled to the second channel terminal;

a second transistor, comprising a second gate, a third channel terminal and a fourth channel terminal, wherein the second gate and the third channel terminal are electrically coupled to the second terminal of the first capacitor, and the fourth channel terminal is for receiving a switch signal;

a second capacitor, comprising a third terminal and a fourth terminal, wherein the third terminal is for receiving a reset signal, and the fourth terminal is electrically coupled to the second terminal of the first capacitor;

a third transistor, comprising a third gate, a fifth channel terminal and a sixth channel terminal, wherein the third gate is electrically coupled to the first terminal of the first capacitor;

a fourth transistor, comprising a fourth gate, a seventh channel terminal and an eighth channel terminal, wherein the fourth gate is for receiving an enable signal, the seventh channel terminal is electrically coupled to a first power supply voltage, and the eighth channel terminal is electrically coupled to the fifth channel terminal; and a light emitting element, comprising an anode and a cathode, wherein the anode is electrically coupled to the sixth channel terminal, and the cathode is electrically coupled to a second power supply voltage, wherein the second power supply voltage is smaller than the first power supply voltage;

a data driver, configured to provide the display data; and a scan driver, configured to provide the scan signal, the reset signal and the enable signal, wherein in a pre-charge period, the scan signal and the enable signal are configured to have high voltage levels and the switch signal is configured to have a low voltage level, wherein in a reset-and-compensation period, the scan signal, the switch signal and the enable signal are configured to have high voltage levels, wherein in a data writing period, the scan signal and the switch signal are configured to have high voltage levels and the enable signal and the reset signal are configured to low voltage levels, wherein in an emission period, the scan signal and the reset signal are configured to have low voltage levels and the switch signal and the enable signal are configured to have high voltage levels, wherein the reset-and-compensation period is after the pre-charge period, the data writing period is after the reset-and-compensation period, and the emission period is after the data writing period.

7. The display device according to claim 6, wherein in the pre-charge period, a rising edge of the reset signal is after a rising edge of the scan signal and a falling edge of the switch signal, wherein in the reset-and-compensation period, a falling edge of the reset signal is after a rising edge of the switch signal.

8. The display device according to claim 6, wherein the light emitting element is implemented with an organic light emitting diode.

9. The display device according to claim 6, wherein each one of the first transistor, the second transistor, the third transistor and the fourth transistor is implemented with a thin film transistor.

10. The display device according to claim 6, further comprising a power supply configured to provided the first power supply voltage and the second power supply voltage.

11. The display device according to claim 6, wherein the display device is implemented with an organic light emitting diode display.

* * * * *